US007219444B2

(12) United States Patent
Hall

(10) Patent No.: US 7,219,444 B2
(45) Date of Patent: May 22, 2007

(54) BOOT LINER WITH ANKLE AND HEEL VOLUME CONTROL

(75) Inventor: William Burton Hall, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 0 days.

(21) Appl. No.: 10/648,851

(22) Filed: Aug. 26, 2003

(65) Prior Publication Data

US 2005/0044749 A1 Mar. 3, 2005

(51) Int. Cl.
*A43B 23/07* (2006.01)
*A43B 17/00* (2006.01)

(52) U.S. Cl. ..... 36/10; 36/50.5; 36/58.5; 36/55

(58) Field of Classification Search ..... 36/10, 36/50.5, 50.1, 58.5, 58.6, 117.6
See application file for complete search history.

(56) References Cited

U.S. PATENT DOCUMENTS

| | | | | | |
|---|---|---|---|---|---|
| 1,845,031 | A | * | 2/1932 | Arthur | 36/140 |
| 1,863,592 | A | * | 6/1932 | Dawes | 36/50.1 |
| 4,620,378 | A | | 11/1986 | Sartor | |
| 4,670,998 | A | * | 6/1987 | Pasternak | 36/114 |
| 4,811,503 | A | | 3/1989 | Iwama | |
| 4,937,953 | A | | 7/1990 | Walkhoff | |
| 4,949,479 | A | | 8/1990 | Ottieri | |
| 4,955,149 | A | | 9/1990 | Ottieri | |
| 4,972,613 | A | * | 11/1990 | Loveder | 36/105 |
| 4,984,375 | A | | 1/1991 | Bonnet | |
| 5,319,869 | A | * | 6/1994 | McDonald et al. | 36/114 |
| 5,937,542 | A | | 8/1999 | Bourdeau | |
| 5,992,057 | A | * | 11/1999 | Monti | 36/89 |
| 6,073,370 | A | * | 6/2000 | Okajima | 36/50.1 |
| 6,082,026 | A | | 7/2000 | Sand et al. | |
| 6,138,384 | A | | 10/2000 | Messmer | |
| 6,467,193 | B1 | | 10/2002 | Okajima | |
| 2003/0154627 | A1 | * | 8/2003 | Hirayama | 36/10 |

* cited by examiner

*Primary Examiner*—Ted Kavanaugh
(74) *Attorney, Agent, or Firm*—Christenson O'Conner Johnson Kindness PLLC

(57) ABSTRACT

An article of footwear, such as a snowboard boot liner, made of deformable material has a rear tensioning system for reducing the volume of the footwear in the heel region. The footwear has a front tensioning system, such as a front lace, for closing an opening in the front of the footwear. A channeling element is positioned over the heel and a control element is secured to the footwear a distance away from the channeling element, for example, over the ankle or instep. A draw, such as a rear lace, winds through both the channeling element and the control element. Tightening the draw urges the control element toward the channeling element thereby reducing the volume of the footwear in the heel region. The draw may be tightened and locked independently or may have an eyelet through which a loop of the front lace may pass in order to transfer tensile forces from the front lace to the draw and maintain tension in the draw. Guides made of tubes or other structures position the eyelet proximate the top of the boot where the front lace is subject to the greatest tensile forces.

20 Claims, 5 Drawing Sheets

BOOT LINER WITH ANKLE AND HEEL VOLUME CONTROL

FIELD OF THE INVENTION

The present invention relates to snowboard boots, and more particularly to lacing systems of snowboard boot liners.

BACKGROUND OF THE INVENTION

Snowboarding is a popular winter sport in which a snowboarder stands atop a snowboard and maneuvers the board over the snow, propelled by gravity. The snowboarder wears boots that are removably attached to the board, with the snowboarder's feet angled with respect to the longitudinal axis of the board. Often the rider's feet are substantially perpendicular to the board axis. The snowboard is controlled by weight transfer and foot movement, both lateral and longitudinal.

A primary skill that must be mastered in snowboarding is carving a path through the snow, rather than simply sliding or skidding over the top of the snow. The ability to carve provides the snowboarder with the most control of the direction and speed of the snowboard. In its simplest execution, a snowboarder carves a path through the snow by shifting his or her weight forward or backward, causing the snowboard to tilt or rotate about its longitudinal axis toward and away from its back side edge. As used herein, front side refers to the side or direction to which the snowboarder's toes are closest (toe side) and back side refers to the opposite side or direction (back side).

In order for a user to most effectively control the snowboard, the user's foot must be firmly gripped by the snowboard boot. It is particularly important that the user's heel be held firmly against shifting when, for example, leaning forward to carve a toe-side turn. Furthermore, snowboard boots typically have a stiff outer shell surrounding a softer inner liner. As the liner breaks down with continued use, it loses its effective grip of the heel and ankle. Furthermore, different users have differently shaped feet, making it difficult to make a boot that will ideally fit a wide range of users. Heel width and shape, for example, vary widely among riders.

Various boot designs attempt to solve these problems. Some ski boot designs involve pulley systems that leverage against the rigid plastic shell of the ski boots to drive the heel of a user against the ski boot. Snowboard boot designs that have attempted to solve this problem have applied tension to the liner at the front of the boot to decrease the circumference of the boot in the entire ankle and heel region. However, other snowboard and ski boots do not provide any means to conform the actual heel and ankle area of the boot to the heel and ankle of a user. Particularly, they do not provide any dynamic shaping or gripping at the sides of the heel.

Thus, it would be an advancement in the art to provide a snowboard boot that can dynamically control the volume of the heel of the boot in order to conform it to the heel of different users. It would be a further advancement in the art to provide a system that ensures that the heel area grips the heel of a user even as the liner breaks down from continued use.

SUMMARY OF THE INVENTION

The present invention provides a system for controlling the volume of the heel and ankle areas of footwear. It is particularly useful with snowboard boot liners that fit inside shells made of relatively stiff material. It includes a rear tensioning system that applies pressure directly at, or around, the heel of footwear shaped to receive a user's foot. The tensioning system may cooperate with a main closure or tensioning system, such as laces or the like, at the front of a boot to transfer tension from a front tensioning system to the rear tensioning system.

A control element, such as a tether, is secured to the liner near the instep and a channeling element, such as an overlay of material, is secured at, or near, the heel. A draw, such as a lace or other tensioning system, is secured to both the channeling element and the control element in order to draw them together. In some embodiments, the draw is a rear lace that winds through the channeling element and control element. One end of the rear lace may attach to part of the footwear in the heel region, proximate the sole. The rear lace may pass through a guide secured to the foot portion or to the channeling element, through an eyelet formed in the control element, and through another guide secured to the channeling element or foot portion. In some embodiments the guides are plastic tubes sized to receive the lace. The rear lace may then secure to the front tensioning system. In some embodiments, the front tensioning system is a front lace, in which case, the front lace may pass through an eyelet, or loop, secured to the rear lace. When the front lace is tightened, it pulls on the eyelet thereby drawing the channeling element and control element together and reducing the volume of the liner in the heel region.

The rear lace may extend up to another guide, such as a plastic tube, secured proximate the top of the footwear. The guide may allow the rear lace to engage the front tensioning system at a point where it can exert the greatest tensile force on the rear lace. For example, where the front tensioning system is a lace, the portion of the lace proximate the top of the footwear will typically be subject to greater tensile forces.

A second draw and a second control element are typically used and disposed in a manner substantially mirroring the disposition of the first draw and first control element. The channeling element is likewise substantially symmetrically shaped and has symmetrically placed guides to accommodate the second draw, which is typically a second rear lace.

In some embodiments, the rear tensioning system is tightenable independent of the front tensioning system. For example, a cord lock, such as might be used to close the opening of a bag, may be used to secure the rear lace. Alternatively, two rear laces could simply be knotted together once tensioned. Accordingly, the laces could be manually tightened and knotted as is done in traditional lacing systems.

The cord lock may secure to a latch attached to the footwear. The latch secures the lock when the cord is being tightened and allows a user to pull on the lace without needing to hold the lock still. The latch is typically a projection with lips formed on it. The lower lip is relatively stiff and secures the cord lock against movement when the rear lace is being tightened. The projection has a compliant upper lip which elastically deforms to allow an aperture in the cord lock to be passed over the projection. After the cord lock is in place, the upper lip springs back and resists removal of the cord lock.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
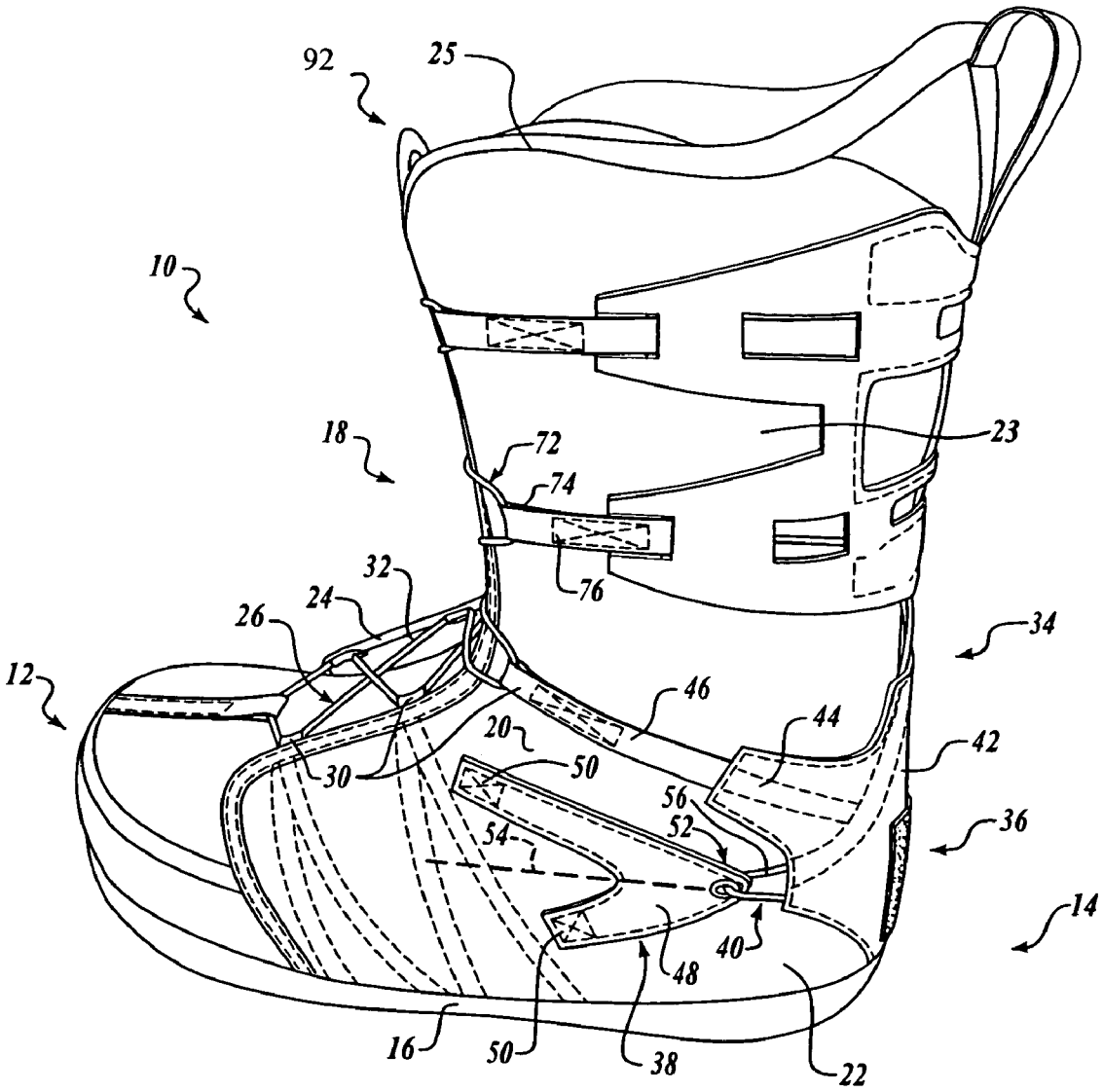
FIG. 1 is a perspective view of a snowboard boot liner in accordance with the invention.
Figure 2:
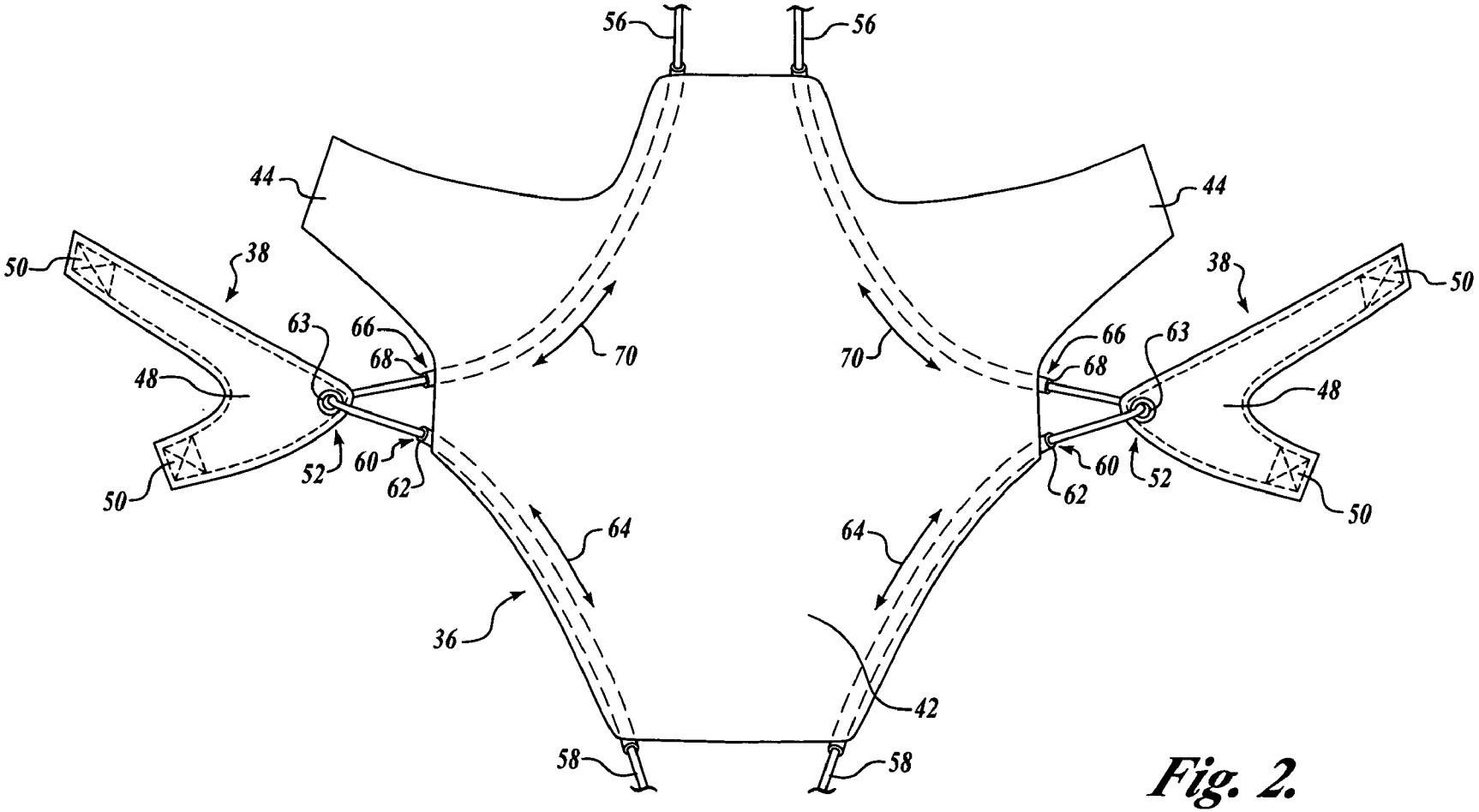
FIG. 2 is an exploded view of a rear tensioning system in accordance with the invention.

Referring to FIGS. 1 and 2, a preferred embodiment of a snowboard boot liner 10 has a front 12 and a back 14 and is shaped like a boot having a sole 16 and a foot portion 18. The sole is made of rubber, plastic, or other suitably resilient material known in the art and a foot portion 18 made of deformable material and shaped to receive the foot and lower leg of a user. The foot portion 18 has a midfoot portion 20 which covers the arch and ankle of a user, a heel portion 22, which covers the heel of a user, and a lower leg portion 23, which encircles the lower leg of a user. The present invention, although applied in this case to a boot liner 10, could be used with any footwear made of compliant material.

A front opening 24 is formed in the foot portion 18 to facilitate donning of the liner 10. A top opening 25 is located at the top of the lower leg portion 23, encircles the leg of a user wearing the liner 10, and likewise facilitates donning of the liner 10. The front opening 24 is disposed toward the front 12. Alternatively, a front opening 24 may be placed toward the back 14, or on either side of the foot portion 18. A front closure or tensioning system 26 serves to constrict the front opening 24. The front tensioning system 26 comprises any tensioning system suitable for fastening footwear, such as a lever system having a locking toggle position, VELCRO™, or the like. In the illustrated embodiment, the front tensioning system 26 is a lacing system having a series of eyelets 30 arranged along the front opening 24 and a front lace 32 threaded through them. The eyelets 30 are hooks, grommets, loops of material, or any other structure suitable for lacing systems.

A rear tensioning system 34 is used in accordance with a preferred embodiment of the invention to control the volume of the heel portion 22. The rear tensioning system 34 includes a channeling element 36 positioned proximate the heel portion 22. The rear tensioning system 34 also includes a control element 38 secured to the midfoot portion. In the embodiment of FIGS. 1 and 2, the rear tensioning system 34 includes two control elements 38 secured opposite one another on either side of the midfoot portion 20. The channeling element 36 and the control element 38, or control elements 38, are positioned at various locations on the heel portion 22 and midfoot portion 20, such that they can be drawn together to constrict the heel portion 22 and midfoot portion 20 around the heel and rear ankle of a user. A rear tensioning system 34 includes a draw 40. The draw 40 serves to pull the control element 38, or control elements 38, toward the channeling element 36, or to pull the control elements 38 toward one another.

In the embodiment of FIGS. 1 and 2, the channeling element 36 is an overlay 42. The overlay 42 covers part of the heel portion 22. In some embodiments, the overlay 42 has one or more branches 44 extending from it secured to one or more tensioning straps 46. The tensioning straps 46 are secured to the lace 32 and have eyelets 30 formed in them. In this manner, the tension of the laces will transfer to the channeling element 36. The overlay 42 is typically constructed of a flexible and resilient material, such as Thermoplastic Polyurethane (TPU), or other suitable material.

In the embodiment of FIGS. 1 and 2, a control element 38 is a control tether 48 secured at one or more securement points 50. The draw 40 secures to a pull point 52 on the control tether 48. The securement points 50 and pull point 52 serve to direct the tension of the draw 40 along a line 54, thereby controlling the volume shaping achieved by the rear tensioning system 34.

The draw 40 is embodied as a rear lace 56. In embodiments having two control elements 38, a rear tensioning system 34 may have two rear laces 56. In the preferred embodiment, a rear lace 56 has one end 58 secured to the sole 16 proximate the back 14. Alternatively, the rear lace may be secured to the body of liner 10 or another component. The rear lace 56 passes through a guide 60, which serves to direct the tension in the rear lace 56. A guide 60 may also be embodied, for example, as a hole or channel formed in the channeling element 36, a hook, a line of stitches, or any other suitable structure.

In the illustrated embodiment, a guide 60 is embodied as a tube 62 secured to the channeling element 36, or secured by the channeling element 36 to the foot portion 18. In some embodiments, the tube 62 is formed monolithically with the channeling element 36. The guide 60 typically has a curvature 64 serving to convert a substantially horizontal pull into a substantially vertical pull exerted on the sole 16. The tube 62, is preferably made of plastic or any other suitable material providing adequate wear resistance, sufficient stiffness to avoid collapse, and reduced friction.

The rear lace 56 then passes through an eyelet 63 secured or formed at the pull point 46 of the control tether 42. The eyelet 63 has various alternate embodiments such as a grommet, hook, or other such structure. The rear lace 56 then extends through another guide 66 secured to the overlay 42. The guide 66 is typically a tube 68 made of plastic, or other suitable material. A guide 66 typically has a curvature 70 enabling it to change the direction of the forces resulting when a rear lace 56 is tensioned. For example, the guide 66 enables a substantially vertical pull applied to the rear lace 56 to be translated into a substantially horizontal pull exerted on the control tether 48. The tube 68 is secured to the foot portion by the overlay 42. Alternatively, it may be secured directly to the overlay 42 or the foot portion 18. The tube 68 may also be formed monolithically or integrally with the overlay 42.

Of course, embodiments other than those illustrated are possible. For example, in some embodiments, the end 58 of a lace 56 secures directly to a control tether 48. In others, the end 58 secures to the overlay 42 directly. In embodiments having two laces 56, the ends 58 may be secured to one another, such that the laces 56 pull against one another when tensioned. Alternatively, an integrated rear lace 56 may be used to achieve the same function as two laces 56 having their ends 58 secured to one another. In some embodiments, a portion of an integrated rear lace 56 extending across the heel portion may serve the function of the channeling element. The overlay 42 may then be omitted and the guides 66 may be embodied as hooks, tubes 68, or the like, secured directly to the foot portion 18.

Referring again to FIG. 1, the draw 40 then engages a lock 72. The lock 72 serves to maintain tension in the draw 40 while the liner 10 is being worn. In the illustrated embodiment, the front lace 32 serves as the lock 72. A rear lace 56 has an eyelet 74 formed or secured to it, with the front lace 32 passing therethrough.

Figure 3:
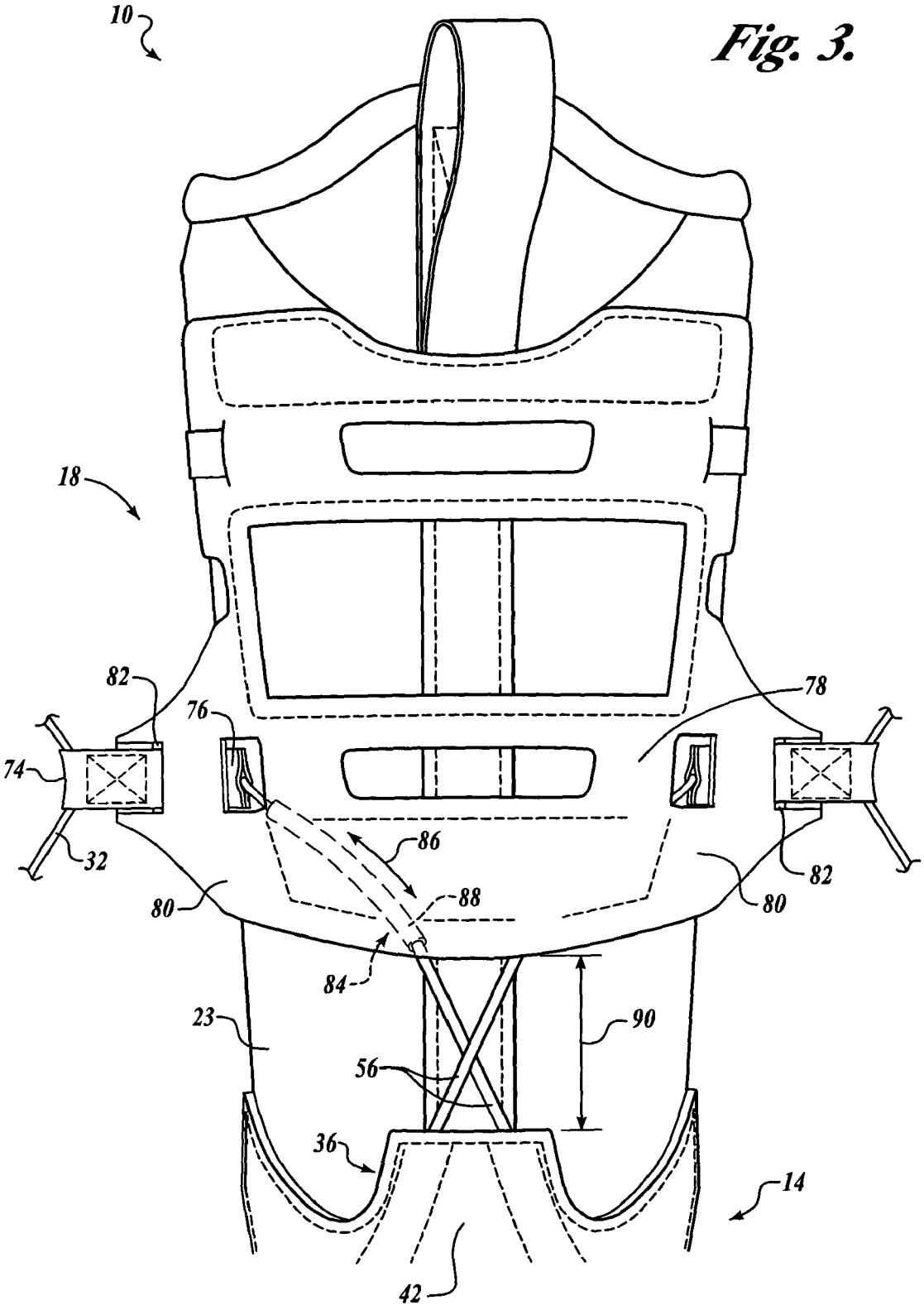
FIG. 3 is a rear view of tensioning and support structures in accordance with the invention.

Referring to FIG. 3, in some embodiments, the eyelet 74 is formed or secured near the end of a pull tether 76 secured to a lace 56. A support 78 is typically secured to the foot portion 18. The support 78 is constructed of a flexible yet relatively stiff material such as TPU. The support 78 typically secures to the foot portion 18 proximate the back 14. In some embodiments, arms 80 are formed as part of the support 78. Such arms 80 extend toward the front 12 and have apertures 82 formed therein with a pull tether 76 passing therethrough. The support 78 serves to maintain a pull tether 76 positioned proximate the front opening 24, even when the front lace 32 is not tensioned.

In some embodiments, guides 84 are secured to the support 78. The guides 84 may also be secured by the support 78 to the foot portion 18, or be secured by some other means to the foot portion 18. A guide 84 typically has a curvature 86, enabling it to translate the substantially horizontal pull of a pull tether 76 into an upward pull. In the illustrated embodiment, the guide 84 is a tube 88, but it may also be a hook 88, or any suitable structure 88. In some embodiments a tube 88, or other such structure 88, is formed monolithically with the support 78. Support 78, in some embodiments, is formed integrally with or otherwise joined to overlay 42.

The guide 84 is typically positioned a distance 90 above the guide 66. This serves to position the pull tether 76 closer to the top of the foot portion 18 and increase the tensile force exerted on the pull tether 76. Typically, a lacing system is tightened by pulling the ends of laces positioned at the top of the shoe or boot. As the lace passes through each set of eyelets in the lacing system, the eyelets exert frictional forces on the lace, reducing the tensile force that can be exerted on subsequent eyelets. Thus, the portion of the front lace 32 at the top of the boot portion 18 will be under greatest tension. The pull tether 76 is therefore subject to greater tensile forces because it engages the front lace 32 near the top of the foot portion 18.

The pull tether 76 secured to a lace 56 and a control tether 48 engaging that same lace 56 are typically positioned on opposite sides of the foot portion 18. Thus, the laces 56 would cross one another, as shown proximate the back 14 in embodiments of the liner 10 having two laces 56.

Figure 4:
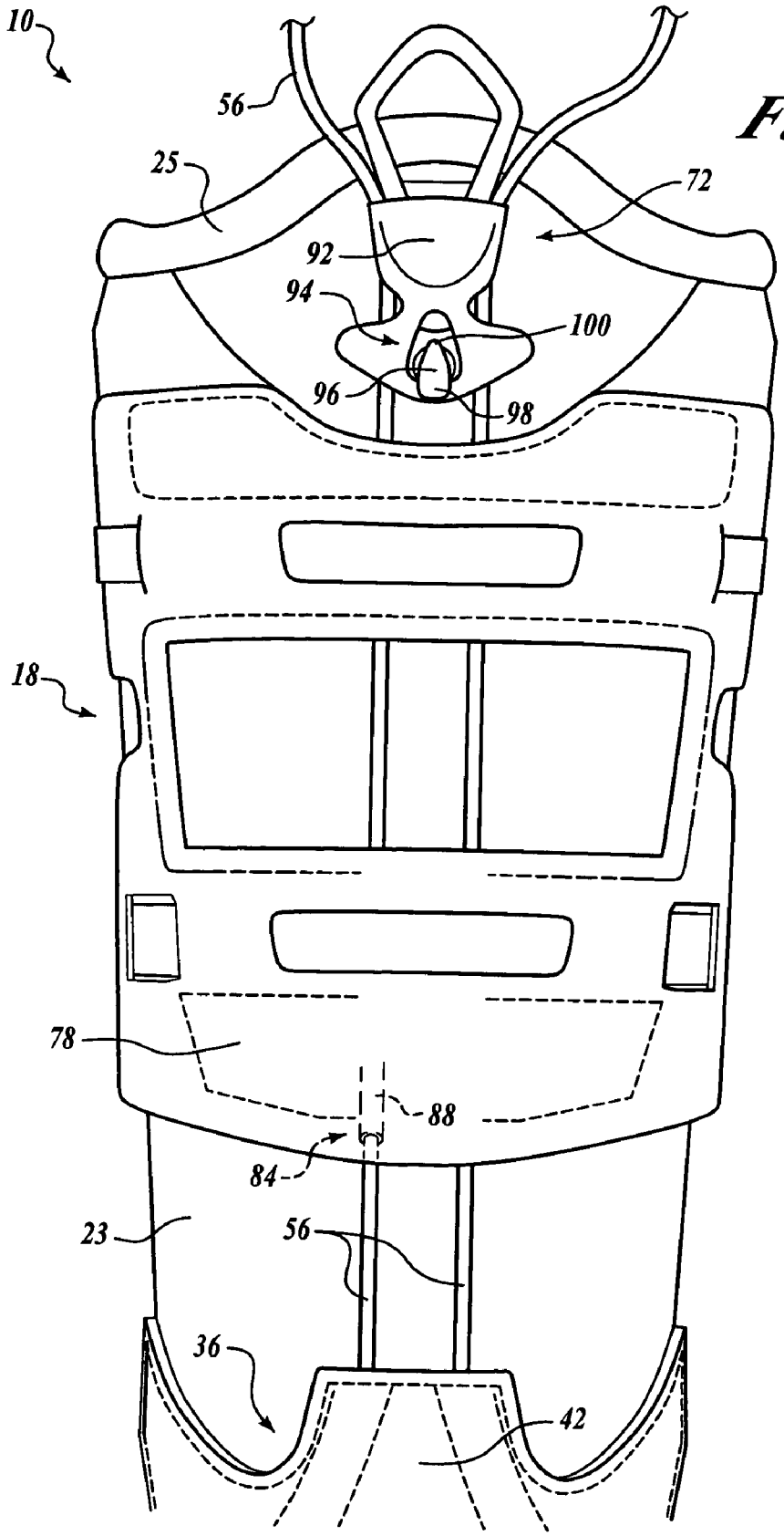
FIG. 4 is a rear view of an alternative embodiment illustrating a rear tensioning system in accordance with the invention.

Referring to FIG. 4, a rear tensioning system may have various embodiments. For example, in FIG. 4, the lock 72 is a cord lock 92. The cord lock 92 may be any structure known in the art to maintain tension in laces, lanyards, drawstrings or the like. In embodiments having two control elements 38 and two laces 56, the lock 72 may also be formed by simply tying the two laces 56 into a knot. The lock 92, of FIG. 4, is positioned at the top of the leg portion 23, proximate the top opening 25, to allow access when the liner is placed within a plastic outer shell. In the embodiment of FIG. 4, the guide 84 is straight, rather than having a curvature 84.

The lock 72 typically secures to a latch 94 on the liner 10. Alternatively, the lock 72 may secure to a latch 94 secured to a shell surrounding the liner. However, the lock 72 may simply be secured to the liner 10 by its engagement with the lace 56, or laces 56. Securing the lock 72 to the liner 10 or to an outer shell permits a user to readily pull the laces 56 there through without requiring a user to hold the lock 72 still.

Figure 5:
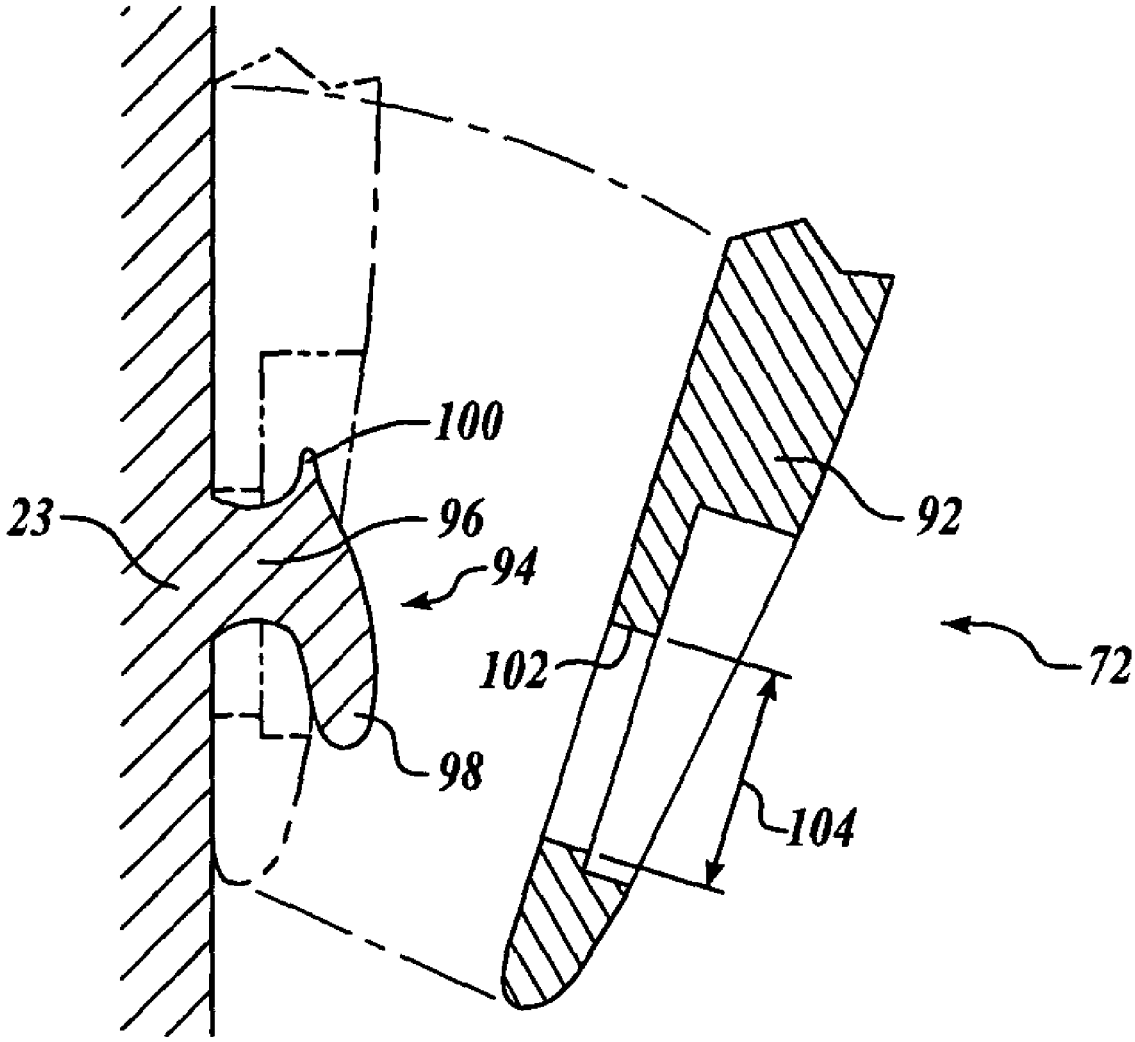
FIG. 5 is partial side view of a latch in accordance with the invention.

Referring to FIG. 5, in some embodiments the latch 94 is a projection 96. The end of the projection 96 has a first lip 98 extending downward and a second lip 100 extending upward. The first lip 98 is typically stiff, enabling it to restrain the cord lock 92 during tightening of the laces 56. The second lip 100 is typically compliant. The cord lock 92 has an aperture 102 having a diameter 104 too small to fit over the undeformed first lip 98 and second lip 100. However, the compliance of the second lip 100 enables the aperture to pass over the lips 98,100 by deforming the second lip 100. Notwithstanding the compliance of the second lip 100, the second lip 100 still serves to restrain the cord lock 92 when positioned over the projection 96 because some force is still required to deform it. The second lip 100 may point in lateral directions as well as upwards to accomplish its function. Likewise, the first lip 98 may point in various directions besides downward in order to provide retention of the cord lock 92.

The latch 94 may have various other embodiments, including other systems used in the art to selectively secure structures. For example, the latch 94 could be embodied as one piece of a side release buckle system, with the other piece secured to the liner 10 or an outer shell. Furthermore, a latch 94 may also secure a cord lock 92 used to tighten a front lace 32. For example, a projection 96 could be secured to the tongue of a boot liner.

While preferred embodiments of the invention have been illustrated and described, it will be appreciated that various changes can be made therein without departing from the spirit and scope of the invention.

What is claimed is:

1. An article of footwear for holding a user's foot, the footwear comprising:

a sole portion having a bottom side and a top side;

a foot portion fixedly secured to the top side of the sole portion and having a front end and a back end, a heel portion for receiving the heel of a user, a midfoot portion for receiving the ankle and arch of a user's foot;

a control element secured to the midfoot portion;

a channeling element engaging the heel portion;

a draw engaging the control element and the channeling element, the draw selectively tensionable to urge the control element toward the channeling element, thereby locally deforming the footwear and reducing the volume of the footwear in the heel region; and a lock selectively engaging the draw to maintain tension in the draw.

2. The footwear of claim 1, wherein the foot portion further comprises an opening for facilitating insertion of a user's foot, the control element being spaced apart from the opening, and the lock comprises a front tensioning system for selectively constricting the opening, the draw being coupled to the front tensioning system to tension the draw whenever the front tensioning system constricts the opening.

3. The footwear of claim 2, wherein the draw is a rear lace having a first end portion secured to a point of attachment proximate an area chosen from the group consisting of the control element, the channeling element, the heel portion, the sole portion, and the midfoot portion, a second end portion coupled to the front tensioning system, and the channeling element further comprises a first guide, the rear lace passing through the first guide.

4. The footwear of claim 3, wherein, the point of attachment is proximate the sole portion, the control element further comprises a control element eyelet, the channeling element further comprises a second guide, the rear lace passing from proximate the sole portion, through the second guide, through the control element eyelet, and through the first guide, and the footwear further comprises a third guide secured to the upper leg portion and spaced apart from the first guide, the rear lace passing from the first guide, through the third guide, and securing to the front tensioning system.

5. The footwear of claim 4, further comprising a second draw and a second control element, the channeling element engaging the second draw, the second draw selectively tensionable to urge the second control element toward the channeling element.

6. The footwear of claim 5, wherein the second draw and second control element generally opposite the position and form of the first draw and first control element, the channeling element's engagement with the second draw opposite the engagement of the channeling element with the first draw.

7. The footwear of claim 6, wherein the first, second, and third guides are tubes sized to receive the rear lace.

8. The footwear of claim 7, wherein the front tensioning system is a lacing system comprising eyelets secured to the foot portion proximate the opening and a front lace threaded through the eyelets, and the channeling element, first control element, and second control element are sheets of thin, flexible material.

9. The footwear of claim 8, wherein the foot portion further comprises a lower leg portion for covering the lower leg of a user, and a support secured to the lower leg portion, the third guide being formed monolithically with the support, the first and second guides being formed monolithically with the channeling element.

10. The footwear of claim 9, further comprising a shell made of a stiff resilient material, the shell being shaped to substantially surround the sole and foot portion, the foot portion being made of a soft deformable material.

11. The footwear of claim 1, wherein the draw comprises a rear lace comprising a first end portion fixedly secured proximate either the heel portion, the midfoot portion, the channeling element, the control element, or the sole, a middle portion slidably secured to the channeling element, and a second end portion engaging the lock, the lock selectively preventing the rear lace from sliding relative to the lock.

12. The footwear of claim 11, further comprising a latch secured to the foot portion, the latch selectively securing the lock to the foot portion.

13. The footwear of claim 12, wherein the foot portion further comprises a lower leg portion for surrounding the lower leg of a user, the lower leg portion comprising a top opening for permitting insertion of a user's foot and lower leg, the latch being secured to the foot portion proximate the top opening.

14. The footwear of claim 13, wherein the channeling element is embodied as an overlay of flexible material secured to the heel portion.

15. The footwear of claim 14, wherein the control element is embodied as a control tether made of a sheet of flexible, resilient material and having a control tether eyelet, the first end portion is secured to the footwear proximate the sole portion, and the channeling element further comprises first and second guides, the middle portion of the lace passing from the sole portion, through the first guide, through the control tether eyelet, and through the second guide.

16. The footwear of claim 15, further comprising a second draw and a second control element, the channeling element engaging the second draw, with the second draw selectively urging the second control element toward the channeling element.

17. The footwear of claim 16, wherein the second draw and second control element substantially mirror the position and form of the first draw and first control element, and the channeling element's engagement with the second draw mirrors the engagement of the channeling element with the first draw.

18. The footwear of claim 17, wherein the first and second guides are tubes sized to receive the rear lace.

19. The footwear of claim 18, further comprising a shell made of a stiff resilient material, the shell being shaped to substantially surround the sole and foot portion, and wherein the foot portion is made of a soft deformable material, and the first and second guides are formed monolithically with the channeling element.

20. The footwear of claim 19, wherein the latch comprises a projection having a first lip and a second lip, the second lip being selectively deformable, and wherein the lock comprises an aperture sized to fit over the first lip and deformed second lip, but sized not to fit over the first lip and undeformed second lip.

* * * * *